US011371798B1

(12) United States Patent
Allen

(10) Patent No.: US 11,371,798 B1
(45) Date of Patent: Jun. 28, 2022

(54) AIR GUN

(71) Applicant: James Eugene Allen, River Oaks, TX (US)

(72) Inventor: James Eugene Allen, River Oaks, TX (US)

( * ) Notice: Subject to any disclaimer, the term of this patent is extended or adjusted under 35 U.S.C. 154(b) by 0 days.

(21) Appl. No.: 17/503,288

(22) Filed: Oct. 16, 2021

(51) Int. Cl.
*F41B 11/721* (2013.01)
*F41B 11/73* (2013.01)
*F41B 11/53* (2013.01)

(52) U.S. Cl.
CPC ..... *F41B 11/721* (2013.01); *F41B 11/53* (2013.01); *F41B 11/73* (2013.01)

(58) Field of Classification Search
CPC ..... F41B 11/721; F41B 11/00; F41B 11/50; F41B 11/51; F41B 11/52; F41B 11/53; F41B 11/54; F41B 11/57; F41B 11/62; F41B 11/64; F41B 11/642; F41B 11/643; F41B 11/71; F41B 11/722; F41B 11/73
USPC ..... 124/72
See application file for complete search history.

(56) References Cited

U.S. PATENT DOCUMENTS 4,770,153 A 9/1988 Edelman
5,709,199 A * 1/1998 Johnson ..... F41B 11/681 124/53.5
6,752,137 B2 6/2004 Brunette et al.
6,915,792 B1 * 7/2005 Sheng ..... F41B 11/53 124/48
7,287,527 B1 10/2007 Piper
8,056,462 B1 11/2011 Lacy et al.
8,136,515 B2 3/2012 Galinson
8,397,706 B2 3/2013 Wood
8,402,959 B1 * 3/2013 Nungester ..... F41B 11/53 124/51.1
8,430,085 B2 4/2013 Tippmann et al.
8,578,922 B1 11/2013 Granger
9,297,606 B2 3/2016 Harvey et al.
9,651,334 B2 5/2017 Evans
9,658,027 B2 * 5/2017 Stevens ..... F41B 11/51
2006/0180134 A1 * 8/2006 Illuzzi ..... F41A 9/24 102/502
2011/0186026 A1 * 8/2011 Tippmann, Sr. ..... F41B 11/00 124/73
2019/0226795 A1 * 7/2019 Sullivan ..... F41B 11/54
2021/0222991 A1 * 7/2021 Kowalczyk, Jr. ..... F41B 11/54

FOREIGN PATENT DOCUMENTS

JP 04045397 A 2/1992

* cited by examiner

*Primary Examiner* — John Cooper
(74) *Attorney, Agent, or Firm* — D. Tiller Law PLLC; Donald Tiller

(57) ABSTRACT

An air gun utilizes high pressure air to rapidly move projectiles from a magazine to the breech of a barrel, and from there out of the barrel. Actuating a trigger opens a valve which directs high pressure air into a turbine/projectile feed disk assembly causing rotation of the assembly about an axle. The rotation rapidly moves projectiles from the magazine to a position at the barrel breech (one at a time) where the high pressure air launches the positioned projectile through the barrel and out the barrel muzzle. The weapon is innovative in the use of high pressure air in an efficient combination of linear and rotational movement to load and rapidly discharge projectiles through a single barrel.

11 Claims, 11 Drawing Sheets

AIR GUN

BACKGROUND

This invention relates to the field of compressed air guns. More specifically, the invention is concerned with the expulsion of variable sized and weights of spherical projectiles at variable rates of discharge, as well as variable velocities and impact power. The invention may also be referred to as a "less-than-lethal" weapon that can be utilized in law enforcement and military operations.

Through the years law enforcement, and to a lesser extent the military, have received criticism for their respective use of lethal force to accomplish the desired objectives of their work. Taking law enforcement as the example, there has been an effort through the past years to incorporate various "less-than-lethal" devices to deal with non-compliant individuals. The most common tools made available to law enforcement officers have been less damaging shotgun rounds such as "bean-bag" rounds and "finned baton" rounds. There have also been larger caliber devices utilized to launch finned rubber baton rounds. Paintball guns have at times been utilized to disperse crowds. The paintball gun is loaded with either rubber, plastic or pepper ball rounds. When a pepper ball strikes a person or object around the intended target(s), it fragments and releases a cloud of powdered irritant causing a burning sensation. Pepper spray has also been used on occasion but the less-than-lethal weapon most employed has been the Taser. This hand held weapon works by simultaneously launching two electrodes (with barbed points) at the non-compliant person. The electrodes are tethered to the base weapon by way of thin conductor wire. It is required that both electrodes penetrate and embed themselves into the skin of the intended target. Once this is accomplished the officer switches on a high voltage/low amperage pulse of electricity from the hand held weapon into the non-compliant individual. This usually results in immediate incapacitation of the person. There have been many other attempts at less-than-lethal weapons but the above are the most commonly utilized. There are risks and deficiencies in each of the above commonly utilized weapons that may never completely be rectified. There have been cases where a lethal round was in a shotgun when the officer thought there was a less-than-lethal round in the chamber. There is a case where a person in a crowd was hit in the eye with a less-than-lethal pneumatically discharged round aimed too high, and died as a result. There is the chance of inflicting a heart attack, seizure or other bodily distress to someone from the Taser's high voltage electrical charge pulsing through a person's body. There are often instances where the Taser electrodes do not penetrate the clothing, or only one electrode connects with the skin which renders the weapon useless. Some people, usually those who have been in the prison system, have learned how to "swipe" the electrodes out of their bodies before the officer can implement the electrical shock. The further away the suspect is, the less effective these weapons are. Normally if the less-than-lethal weapon fails there is an officer with a lethal weapon as back-up which could result in a less desirable outcome.

There are mechanical issues with less-than lethal weapons utilizing projectile launching as a means for compliance. Most projectile launchers utilize a complicated sliding block system for cycling ammunition into the breech such as Tippman-Pat. U.S. Pat. No. 8,430,085 B2 that also utilizes a rotating mechanically activated magazine with projectiles loaded into individual holders and holders ejected as the projectile is launched. Some use electric motors in conjunction with high pressure air such as U.S. Pat. No. 8,136,515 to Galinson comprising a complicated combination of electrically operated rotating barrels and a feed system that has many operating parts. These weapons are susceptible to jamming and a number of other possible mechanical failures that are unacceptable in a law enforcement arena. There are less complicated devices that have been invented such as U.S. Pat. No. 7,287,527 to Piper which utilizes pure compressed air to launch small caliber projectiles which are loaded in a magazine and are free floating in a chamber where the individual projectiles are picked up and launched out the barrel. This would be an acceptable alternative but is limited to small caliber projectiles in order to be light weight enough to be lifted into the barrel with only the air flow available.

There is a need for a more reliable means of less-than-lethal effective compliance for law enforcement. There needs to be a weapon that will allow law enforcement a means to impose compliance to an individual, or a group of individuals, while maintaining a safe distance away. It is believed the invention described here meets that need. Although the use of any weapon has the possibility of seriously injuring a person, this invention provides a dependable less-than-lethal means of compliance from a safe, stand-off distance. The compliance level of strike power is fully and immediately adjustable by the user if more subtle impact is not enough to achieve compliance without moving to the use of lethal force. A primary objective of the invention is to provide law enforcement officers with a versatile; less-than-lethal, "stand-off" weapon system to assist in providing compliance in apprehending those engaged in suspected criminal or other Illegal activities. Another objective is to provide less-than-lethal opportunities for compliance in more situations than are now available to law enforcement. Being a stand-off weapon with immediately adjustable power modulation allows the officers to use the weapon in situations out of range of many of the currently available less-than-lethal weapons. The weapon could benefit private citizens with an effective stand-alone less-than-lethal means of resisting home invasion suspects where the outcome of employing a lethal weapon could possibly result in terminal injury to the assailant. Taking a person's life by using a lethal weapon, even when justified for protection of life and property, could result in psychological trauma of the homeowner. The outcome could have been to simply deter the person(s) from remaining on the property or holding them for law enforcement.

Another feature of this weapon is no wasted reciprocating movement and, or, rotating barrels. There are few moving parts and no electrical components involved in the overall process. The ammunition is 100% re-usable. This is a great cost savings advantage for law enforcement training in closed quarters or on the firing range. The weapon is versatile in that one may select an infinite number of combinations of air pressure, size, weight and material of spherical projectiles. There is minimal recoil in using this weapon. There is "push back" from the principle of "equal and opposite reaction" depending on the amount of pressure selected and the weight of the projectile. It has been engineered to be economical to operate and requires little to no maintenance.

Barrel inserts are interchangeable allowing different size caliber bores. Similarly the projectile feed disk is interchangeable to match the size of the barrel bore. The sizes and types of spherical ammunition are limitless up to, but not limited to, .68 caliber.

Various barrel inserts may be utilized to launch, for example, .38 ca. steel, plastic, aluminum, ceramic or other material type projectiles as well as other sizes and types such as specialized pyrotechnic rounds which could create a (flash/sonic) effect upon impact. The weapon could be further modified to provide two magazines with two barrels and a larger feed disk with a double feed rail for two barrels. This would provide twice the output rounds per second. The stationary barrel in the current embodiment is .68 caliber. However, the stationary barrel may be larger if desired. The weapon could also be pedestal mounted on a vehicle where a high pressure compressor and storage tank could be a part of the vehicles equipment. Another possibility is mounting the regulator on the device in a way the regulator becomes a front support handle that can be rotated to control the power of the projectile output.

SUMMARY

In a preferred form, an air gun according to an aspect of the invention is intended to provide rapid and controlled expulsion of spherical projectiles utilizing pressurized gas (e.g., from a backpack-mounted high-pressure air tank connected to the device by way of flexible hose). The device is activated by depressing a trigger which activates a valve, thereby releasing pressurized air to flow tangent to the turbine veins of a drive unit. The air then passes through the turbine blades creating rotational motion of the turbine. A projectile feed disk of substantially the same size disk as the turbine disk is attached directly to the turbine. The projectile feed disk incorporates a circular 360 degree relief groove in accordance with the size of spherical projectiles contained in the magazine. The centerline of the relief groove aligns with the center of the barrel breech. The projectile feed disk is connected to a tubular magazine which is configured to hold the projectiles. The projectiles in the magazine are kept in contact with the projectile feed disk by way of a spring loaded piston located at the forward end of the magazine. (In an another exemplary implementation, the magazine may be positioned such that gravity, or some combination of gravity and spring force, is used to keep the projectiles in contact with the feed disk.) The projectile feed disk relief groove is ported completely through to the back of the disk exposing the turbine veins. This allows the air moving through the turbine rotor to pass through the back side of the projectile feed disk, into the barrel breech, and then through the barrel and out the muzzle. With a continuous rotation of the feed disk in one direction, with no obstructions to the projectile, there is little opportunity for projectiles to jam or become dislodged in any way. The turbine and attached projectile feed disk is stabilized by a stationary axle shaft attached perpendicular to the centerline of a rear seal plate. Two roller bearings are attached, one each to the projectile feed disk and turbine, and ride on the axle shaft to provide a stable platform for the turbine and feed disk around which to rotate. As the air stream begins to rotate the turbine, the connected projectile feed disk also rotates collecting projectiles from the magazine and moving them along the rotational arc of the relief slot until the lead projectile contacts a guide at the breech end of the barrel. At this point the projectile is positioned in the stream of the exhausting turbine air, and the air forces the projectile through the barrel and out the muzzle. The relief groove is constantly loaded with projectiles in succession around the majority of the disk with the assist of the spring-loaded (or gravity-fed) magazine piston. After the first projectile is collected by the air stream moving through the barrel, the next projectile in the projectile feed disk groove rapidly move into position and is carried by the air stream through and out of the barrel, almost immediately behind the first projectile. There may be several projectiles moving down the barrel at the same time. This process will continue until either the trigger is released or the ammunition runs out.

BRIEF DESCRIPTION OF THE DRAWINGS

These and other features, aspects, and advantages of the present invention will become better understood with reference to the following description, appended claims, and accompanying drawings where:

DETAILED DESCRIPTION

Figure 1A:
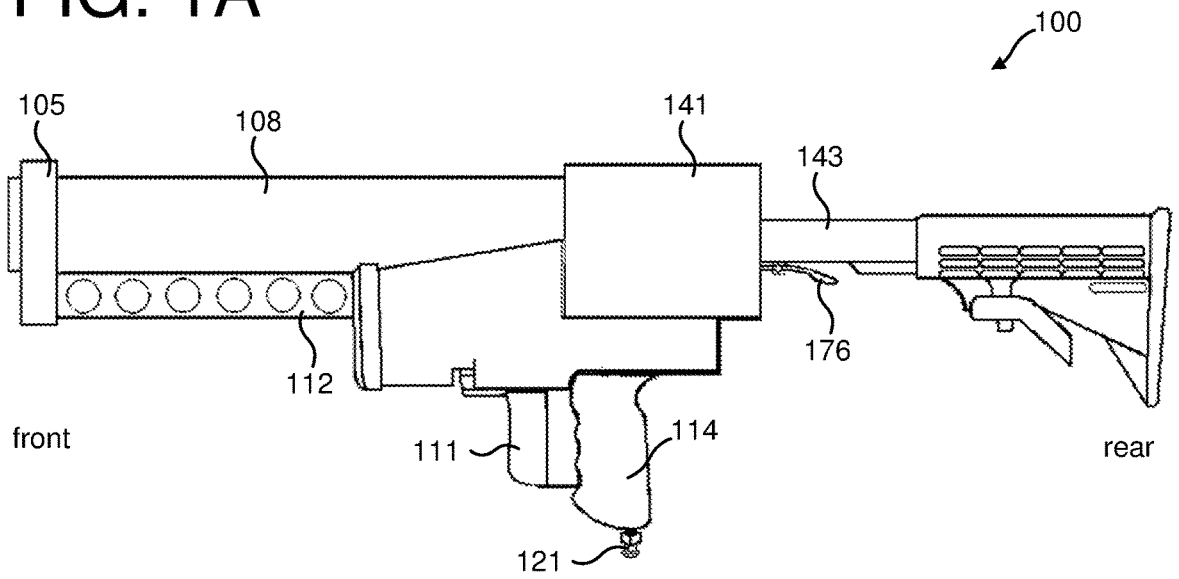
FIG. 1A is a side elevation view illustrating an exemplary compressed-air gun according to an aspect of the invention.

In the summary above, and in the description below, reference is made to particular features of the invention in the context of exemplary embodiments of the invention. The features are described in the context of the exemplary embodiments to facilitate understanding. But the invention is not limited to the exemplary embodiments. And the features are not limited to the embodiments by which they are described. The invention provides a number of inventive features which can be combined in many ways, and the invention can be embodied in a wide variety of contexts. Unless expressly set forth as an essential feature of the invention, a feature of a particular embodiment should not be read into the claims unless expressly recited in a claim.

Except as explicitly defined otherwise, the words and phrases used herein, including terms used in the claims, carry the same meaning they carry to one of ordinary skill in the art as ordinarily used in the art.

Because one of ordinary skill in the art may best understand the structure of the invention by the function of various structural features of the invention, certain structural features may be explained or claimed with reference to the function of a feature. Unless used in the context of describing or claiming a particular inventive function (e.g., a process), reference to the function of a structural feature refers to the capability of the structural feature, not to an instance of use of the invention.

Except for claims that include language introducing a function with "means for" or "step for," the claims are not recited in so-called means-plus-function or step-plus-function format governed by 35 U.S.C. § 112(f). Claims that include the "means for [function]" language but also recite the structure for performing the function are not means-plus-function claims governed by § 112(f). Claims that include the "step for [function]" language but also recite an act for performing the function are not step-plus-function claims governed by § 112(f).

Except as otherwise stated herein or as is otherwise clear from context, the inventive methods comprising or consisting of more than one step may be carried out without concern for the order of the steps.

The terms "comprising," "comprises," "including," "includes," "having," "haves," and their grammatical equivalents are used herein to mean that other components or steps are optionally present. For example, an article comprising A, B, and C includes an article having only A, B, and C as well as articles having A, B, C, and other components. And a method comprising the steps A, B, and C includes methods having only the steps A, B, and C as well as methods having the steps A, B, C, and other steps.

Terms of degree, such as "substantially," "about," and "roughly" are used herein to denote features that satisfy their technological purpose equivalently to a feature that is "exact." For example, a component A is "substantially" perpendicular to a second component B if A and B are at an angle such as to equivalently satisfy the technological purpose of A being perpendicular to B.

Except as otherwise stated herein, or as is otherwise clear from context, the term "or" is used herein in its inclusive sense. For example, "A or B" means "A or B, or both A and B."

Figure 1B:
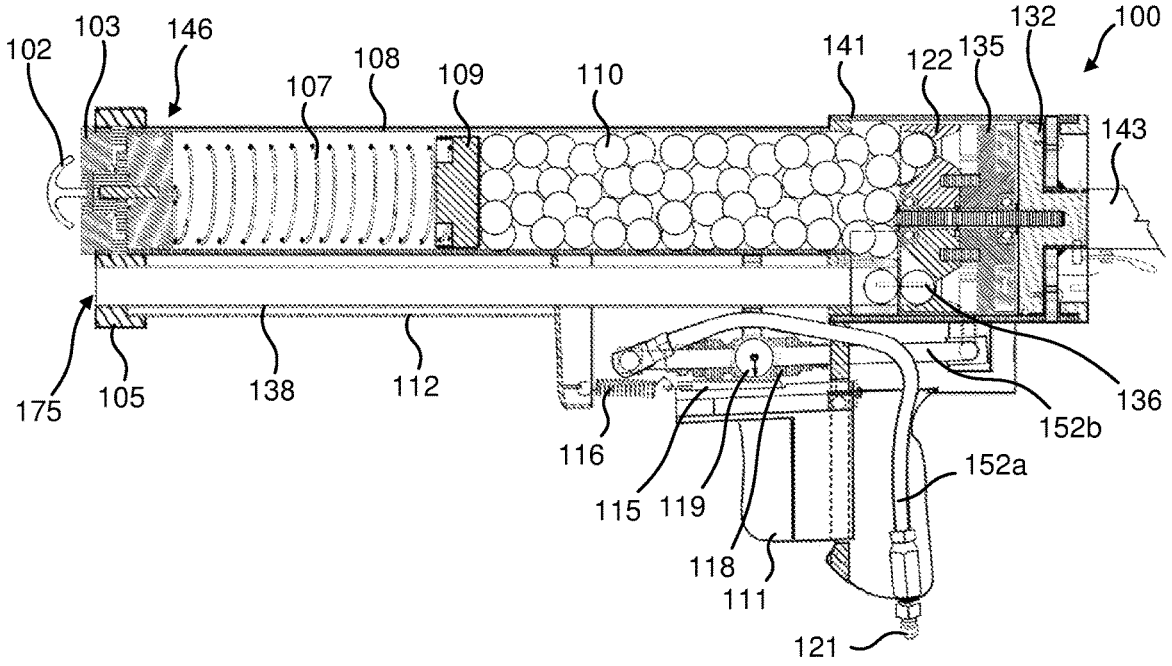
FIG. 1B is a side sectional view illustrating an exemplary compressed-air gun according to an aspect of the invention.

FIG. 1A presents a side elevation view of an exemplary compressed-air gun 100 according to an aspect of the invention. FIG. 1B presents a side sectional view of the gun 100. The gun 100 includes a barrel 138 disposed in a barrel guard 112. The barrel 138 terminates at one end in a muzzle 175 and at the other in a breech. The gun 100 also includes a magazine 108 configured to hold projectiles 110. The projectiles 110 are fed from the magazine 108 to the breech end of the barrel 175 utilizing a feed disk 122. The feed disk 122 is connected to a turbine 135, which is configured to be driven by compressed air ultimately provided through a supply air fitting 121. The gun 100 is a substantially airtight pressure vessel with the only exit for the high pressure air being the barrel muzzle 175.

The tubular magazine 108 is sealed at one end with a cam-lock seal assembly 146 and terminates at the other end in the feed disk 122. A magazine piston 109 is disposed within the magazine 108 and is energized by a piston spring 108 that attaches the piston 109 to the seal assembly 146. Projectiles 110 are disposed in the magazine 108 between the piston 109 and the feed disk 122. The piston spring forces the piston 109 against the projectiles 110, pushing the projectiles toward the feed disk 122. A user may load the magazine 108 by using a cam-lock pull handle 102 to release cams that lock the seal assembly 146 in place relative to the magazine 108. For example, the cams may engage a stabilizing collar 105 (or the housing of the magazine 108) attached to the magazine 108 and barrel 138. Rotation of the handle 102 may disengage the cams, enabling the user to pull out the seal assembly 146, along with the attached piston 109 and spring 107. With the seal assembly 146 removed, the magazine 108 is open and the user may add projectiles 110. For example, projectiles 110 may be poured into the magazine 108 when the magazine 108 is angled toward the vertical. Once projectiles 110 have been added to the magazine, the user may replace the piston 109, spring 107, and seal assembly 146. The cams are then reengaged using the handle 102. In the exemplary gun 100, the handle 102 is connected to a cam-lock cover 103 such that the handle 102 may be folded to be flush with, or inserted into, the cover 103. (As depicted in FIG. 1A, the handle is folded into the cover 103. As depicted in FIG. 1B, the handle 102 is folded out from the cover 103 to enable loading/unloading of the magazine 108.)

The gun 100 is operated by high pressure air supplied by an external back-pack tank or a smaller high pressure tank attached to the device (not shown). Pressurized air is provided to a supply air valve 118 by way of a high pressure hose connected to the supply air fitting 121. The gun 100 is activated by depressing a trigger 111 (connected to a pistol grip 114) which creates the linear movement of the valve activator gear rack 115, which in turn rotates the valve actuator gear 119 that is to the connected supply air valve 118, thereby opening the valve 118. When the valve 118 is open, pressurized air may flow from the supply fitting 121, through a first supply-line segment 152*a* (connecting the supply fitting 121 to the valve 118) and a second supply-line segment 152*b* (connecting the valve to an inlet to the turbine 135) to the turbine 135. The pressurized air impacts blades of the turbine 135, causing the turbine 135 and feed disk 122 to rotate. The feed disk 122 includes a groove configured to capture one or more projectiles 110 and deliver it to the breech end of the barrel 138 and a through port configured to allow pressurized air to flow through the disk 122 into the barrel 138, and thereby carry the projectile 110 into and through the barrel 138 to exit at the muzzle 175. The projectiles 110 are carried in the groove of the rotating feed disk 122, travelling in an arc motion with the disk 122 until the lead projectile is stopped in alignment with the barrel breech by a shot guide 136. At this point, exhaust air escaping from the turbine 135 moving through the through port of the feed disk 122 carries the projectile 110 from the breech into the barrel 138 and out the muzzle 175. Almost immediately upon one projectile 110 being carried from the breech into the barrel 138 another projectile 110 follows in close succession. This process will continue until either the magazine 108 empties or the trigger 111 is released.

Figure 2A:
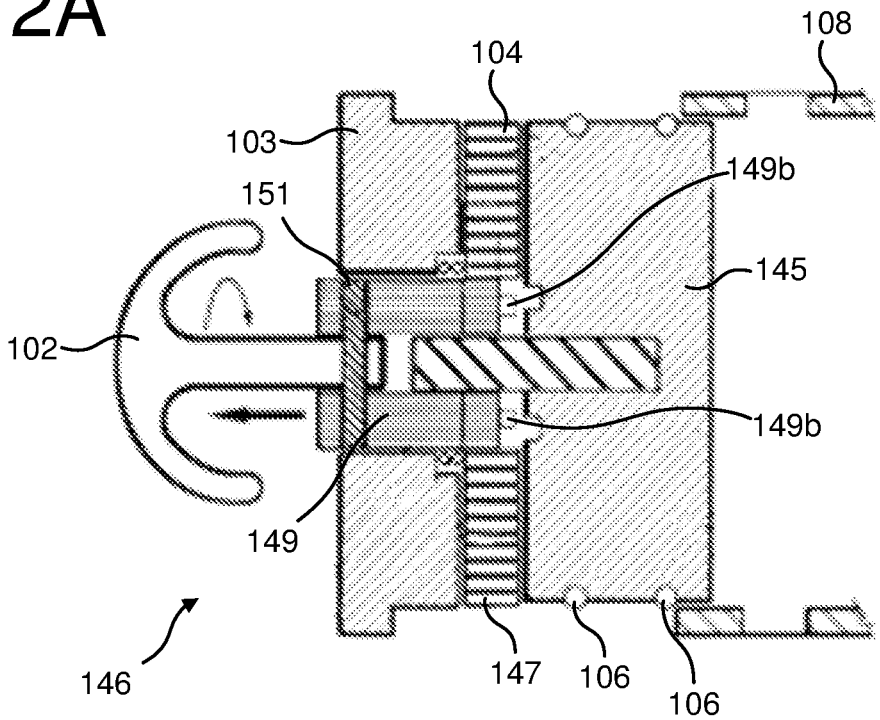
FIGS. 2A-2B are side sectional views illustrating a front exemplary magazine seal assembly according to an aspect of the invention.
Figure 2B:
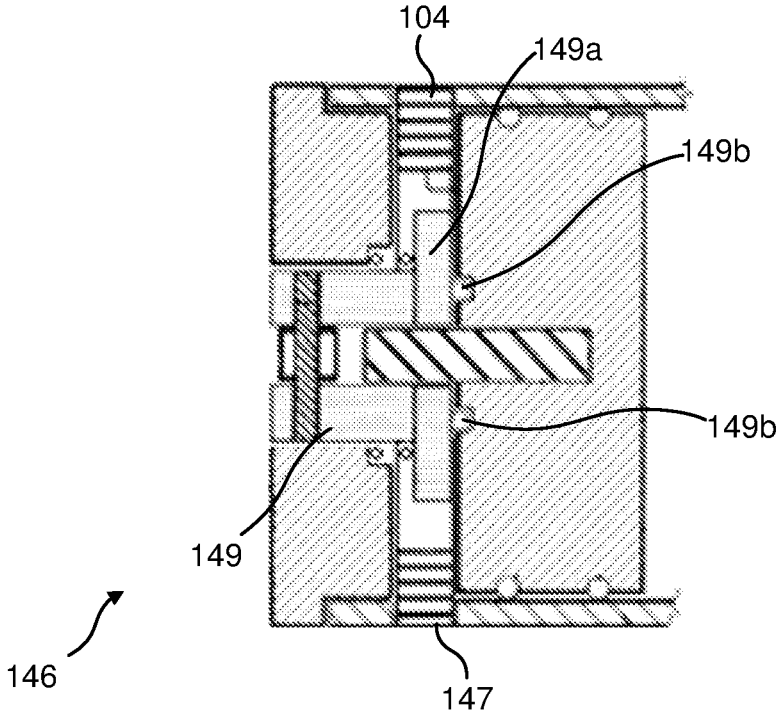
Figure 3:
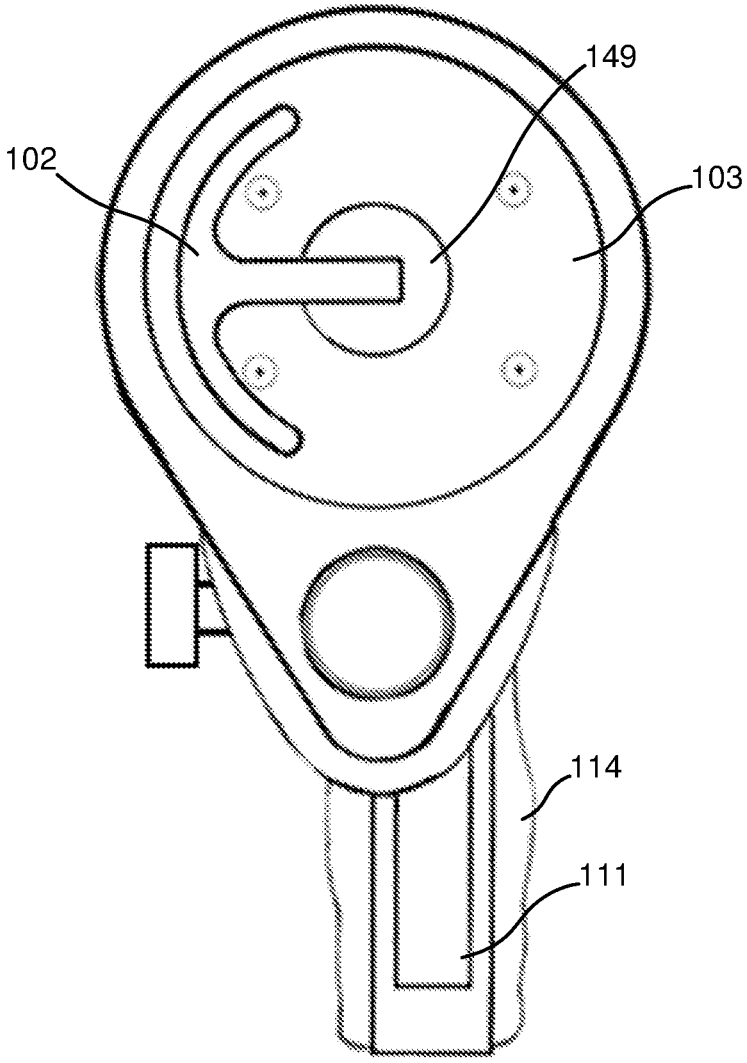
FIG. 3 is a front elevation view illustrating a front exemplary magazine seal assembly according to an aspect of the invention.
Figure 4A:
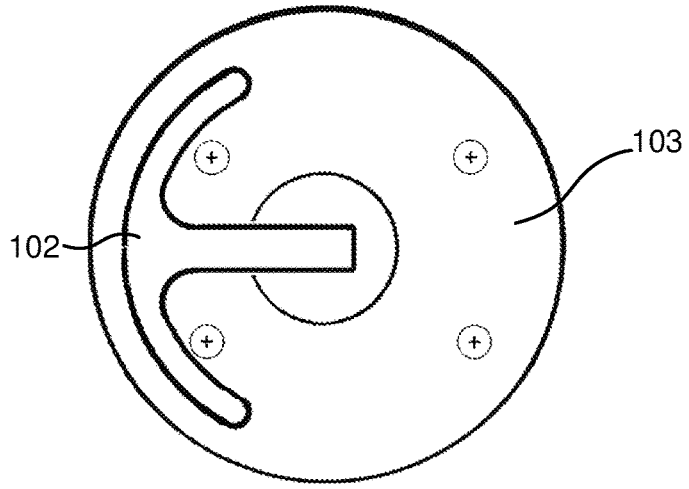
FIGS. 4A-4C are front sectional views illustrating a front exemplary magazine seal assembly according to an aspect of the invention.
Figure 4B:
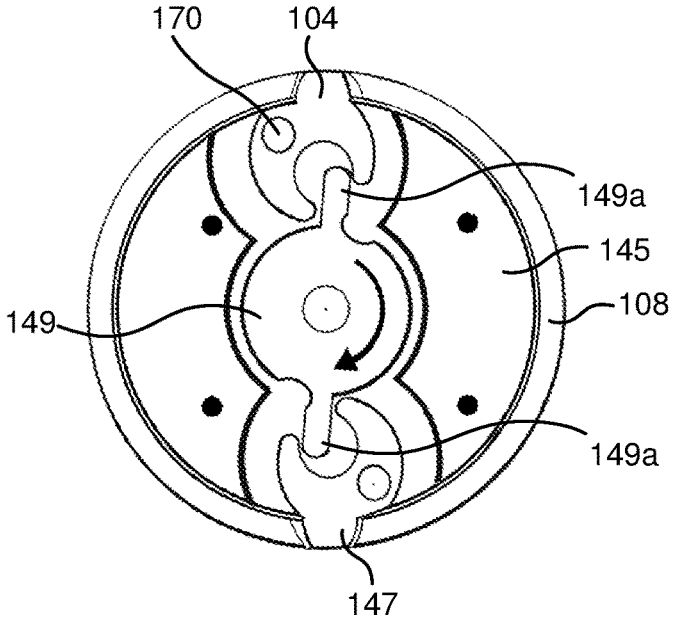
Figure 4C:
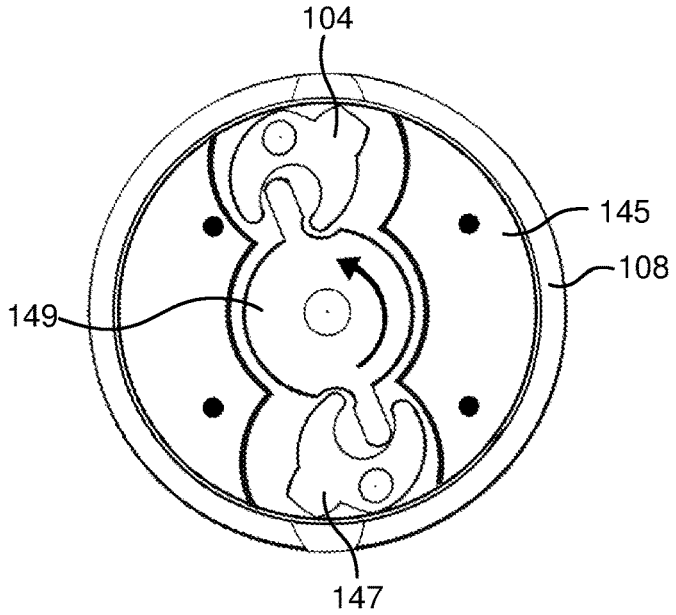

Sealing of and access to the magazine 108 can be further understood with reference to FIGS. 2A, 2B, 3, 4A-4C. FIGS. 2A and 2B are side sectional views of the magazine seal assembly 146. FIG. 2A illustrates the seal assembly 146 as unlocked and mostly removed from the housing of the magazine 108. FIG. 2B illustrates the seal assembly 146 inserted into the housing of the magazine 108 and locked in place with cams 104, 147 that are pivotably attached to a seal body 145 via pivot posts 170. The seal assembly seals the front end of the magazine 108 with O-rings 106. The cam-lock pull handle 102 is pivotably attached to a cam actuator 149 via a pivot pin 151. The handle 102 is pivoted out from the actuator 149 in FIG. 2A and is pivoted in FIG. 2B. FIG. 3 is a front elevation view of the gun 100 illustrating the cam-lock pull handle 102 in the stowed position (i.e., pivoted into the cam actuator 149 and cover 103). FIG. 4A is a front sectional view illustrating the handle 102 in the stowed position. FIG. 4B is a front sectional view illustrating the cam actuator 149 in position to lock the cams 104, 147 into the housing of the magazine 108. FIG. 4C is a front sectional view illustrating the cam actuator 149 in position to unlock the cams 104, 147 from the housing of the magazine 108. In operation to remove the seal assembly 146 from the magazine 108, the user pivots the handle 102 out from the cam actuator 149, pulls the handle 102 away from the magazine 108 to release spring-loaded lock pins 149*b* on the actuator 149 (when engaged, the lock pins 149*b* prevent rotation of the actuator 149), and rotates the handle 102 to rotate the actuator 149 so the portions 149*a* of the actuator engage and move the cams 104, 147 to release the cams 104, 147 from the housing of the magazine 108 (or the stabilizing collar 105). The user may then pull on the handle 102 to remove the seal assembly 146 from the magazine 108. In operation to install the seal assembly 146 in magazine 108, the user inserts the seal assembly 146 into the magazine, aligns the assembly 146 so that the cams 104, 147 align with cam receptacles (which alignment may be aided by one or more guide pins), and then rotates the handle 102 to move the cams 104, 147 to engage the housing of the magazine 108 (or the stabilizing collar 105). The lock pins 149*b* may then be engaged and the handle 102 placed in the stowed position.

Figure 5A:
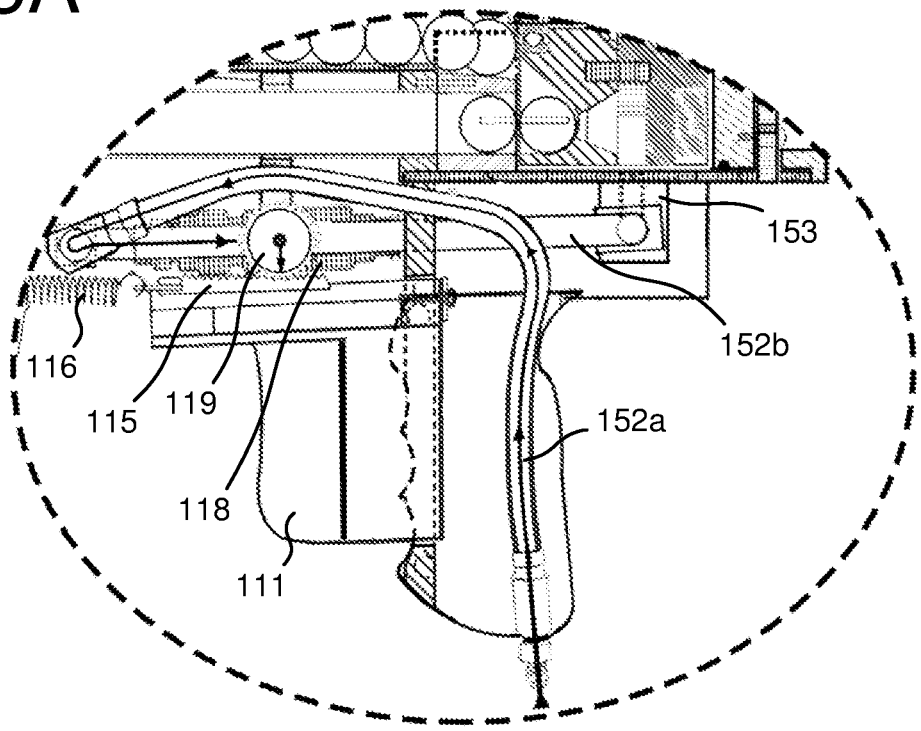
FIGS. 5A-5B is a side sectional view of a trigger section of an exemplary compressed-air gun illustrating air flow in two trigger states according to an aspect of the invention.
Figure 5B:
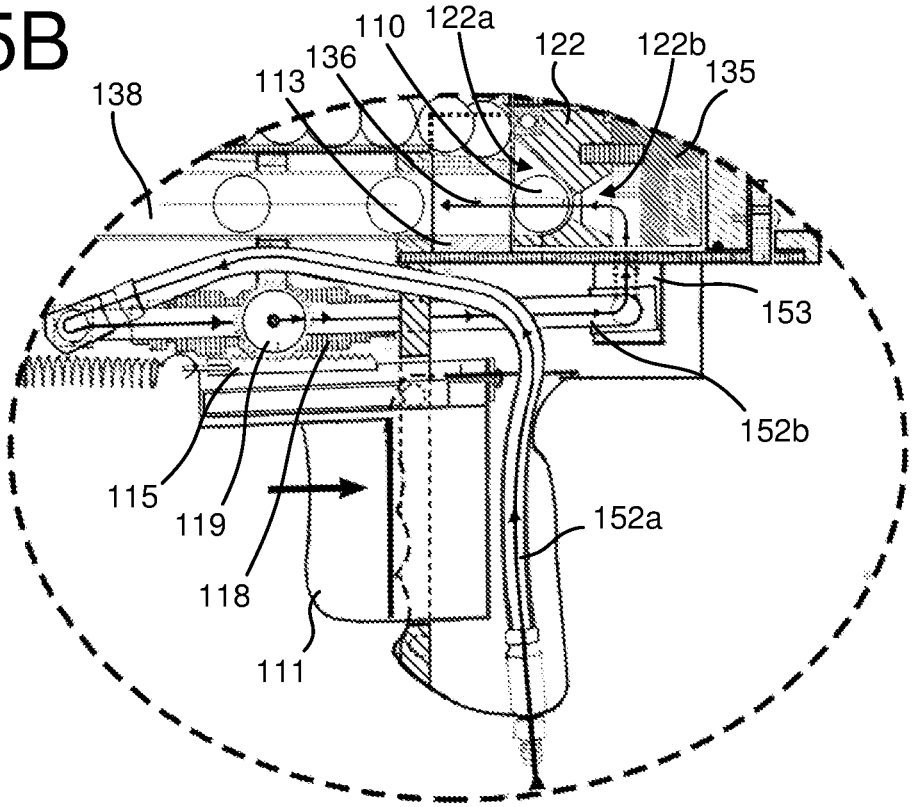

Air flow during operation of the exemplary gun 100 can be further understood with reference to FIGS. 5A and 5B, which each depict a section of the gun 100. FIG. 5A depicts the gun in a trigger-off state. In this state, the trigger 111 is not depressed but rather is held on the "off" position by a return spring 116 and the valve actuator gear 119 is positioned such that the valve 118 is closed. As shown by the arrowed line in the first supply-line segment 152*a*, pressurized air may flow from the supply fitting 121 to the valve 118, but no further. Thus, the turbine 135 and feed disk 122 will never be engaged and projectiles will not be launched from the gun 100. FIG. 5B depicts the gun in a trigger-on state. In this state, the trigger 111 is depressed, moving the valve-actuator gear rack 115 to rotate the valve actuator gear 119 to open the valve 118. As shown by the arrowed lines in the first supply-line segment 152*a* and the second supply-line segment 152*b*, pressurized air may flow from the supply fitting 121 through the valve 118, to a turbine inlet manifold 153. From there, the air may flow into the turbine 135 to engage turbine blades (thereby causing the previously mentioned rotation of feed disk 122) and through a through-port 122*b* of the feed disk 122 to engage a projectile 110 in the groove 122*a* of the feed disk 122, thereby forcing the projectile 110 into and through the barrel 138. As shown in FIG. 5B, the projectile 110 that is launched through the barrel 138 is stopped at the breech position by the shot guide 136 which is provided by an insert 113. The spring 116 will return the valve 118 to the closed position (as shown in FIG. 5A) once force is no longer applied to squeeze the trigger 111. Thus, the trigger may be held to empty the magazine 108 (or to deplete the air supply) or it may be depressed intermittently for relatively short bursts of projectiles.

Figure 6:
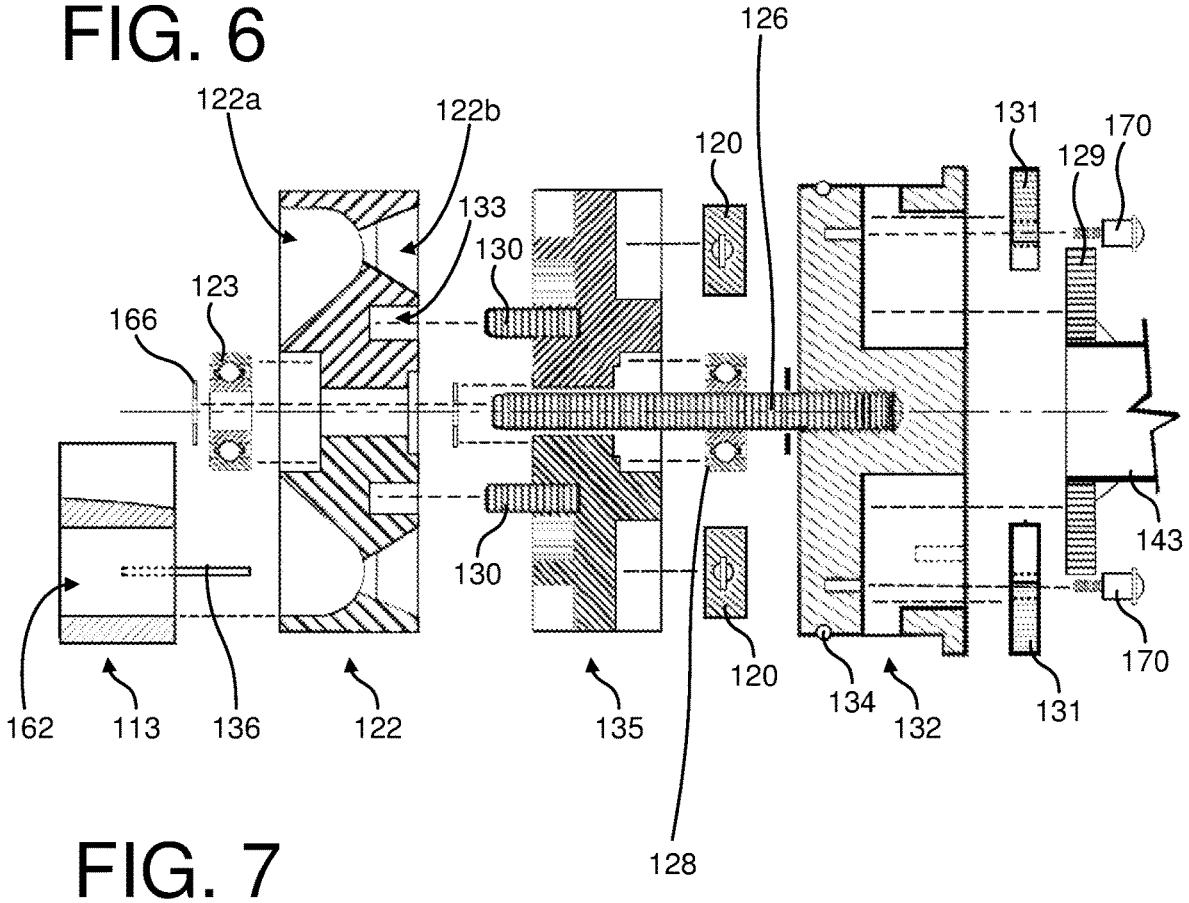
FIG. 6 is an explode side sectional view of a drive assembly of an exemplary compressed-air gun according to an aspect of the invention.

FIG. 6 is an exploded side sectional view of the feed-disk/turbine drive assembly. This assembly includes the feed disk 122 and turbine 135, as well as a rear seal plate 132. The feed disk 122 and turbine 135 are disposed on a feed-unit axle 126 that is fed through the centers of disk 122 and turbine 135 and that is supported by first 123 and second 128 bearings that are connected to the feed disk 122 and turbine 135 respectively. The feed disk 122 and turbine 135 are connected together with drive pins 130. One end of the axle 126 is connected to the rear seal plate 132 and retaining clip 166 may be used to secure the feed disk 122 to the axle 126 at the other end of the axle 126 (securing the feed disk 122 and turbine 135 between the seal plate 132 and binding clip 166). Another retaining clip may be placed between the feed disk 122 and turbine 135. This enables removal of the feed disk 122 from the axle 126 while the turbine 135 remains positioned on the axle 126. The drive assembly may be secured in the housing 141 of the gun 100 using rear cam locks 131 attached to the rear seal plate 132 on pivot posts 170. The cam locks 131 selectively engage the housing 141 when rotated about the pivot posts 170 in one direction and disengage the housing when rotated about the pivot posts 170 in the opposite direction. The air seal between the seal plate 132 and housing 141 is effected by one or more O-rings 134.

Figure 7:
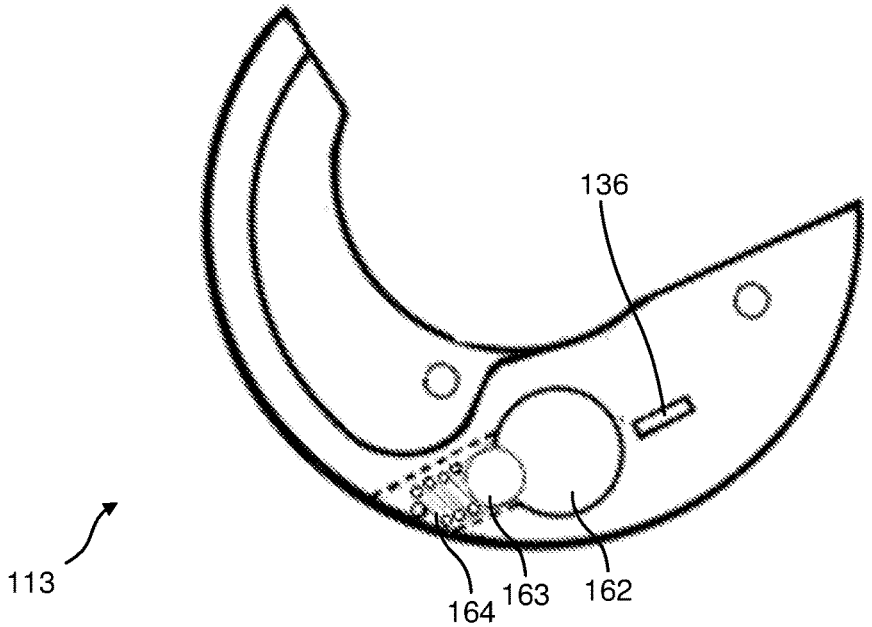
FIG. 7 is a front elevation view of an exemplary barrel insert according to an aspect of the invention.

FIG. 7 is a front elevation view of the insert 113 with the shot guide 136. The insert includes an alignment passage 162 sized appropriately for the projectile 110, a shot-stop ball 163, and a spring 164 positioned to load the shot-stop ball 163 into the alignment tube 162. Due to the magazine piston 109 and piston spring 108, projectiles 110 in the magazine 108 experience a force toward the feed disk 122 and ultimately toward the breech end of the barrel 138 through the alignment passage 162. When air is not provided to the turbine 135 (in the trigger-off state or when there is no air supply), the shot-stop ball 163 will engage a projectile 110 in the alignment passage 162 to keep the projectile 110 from entering the barrel 138 (thus blocking the alignment passage 162 to keep other projectiles 110 from entering the barrel). When pressurized air is provided to the turbine 135 (in the trigger-on state), the air will force the projectile 110 stopped by the shot-stop ball 163 toward the muzzle 175. Air of sufficient pressure will generate enough force on the projectile 110 to compress the spring 164, moving the shot-stop ball 163 out of the alignment passage 162 and allowing the projectile to travel into and through the barrel 138 to be launched from the gun 100 at the muzzle 175.

Figure 8A:
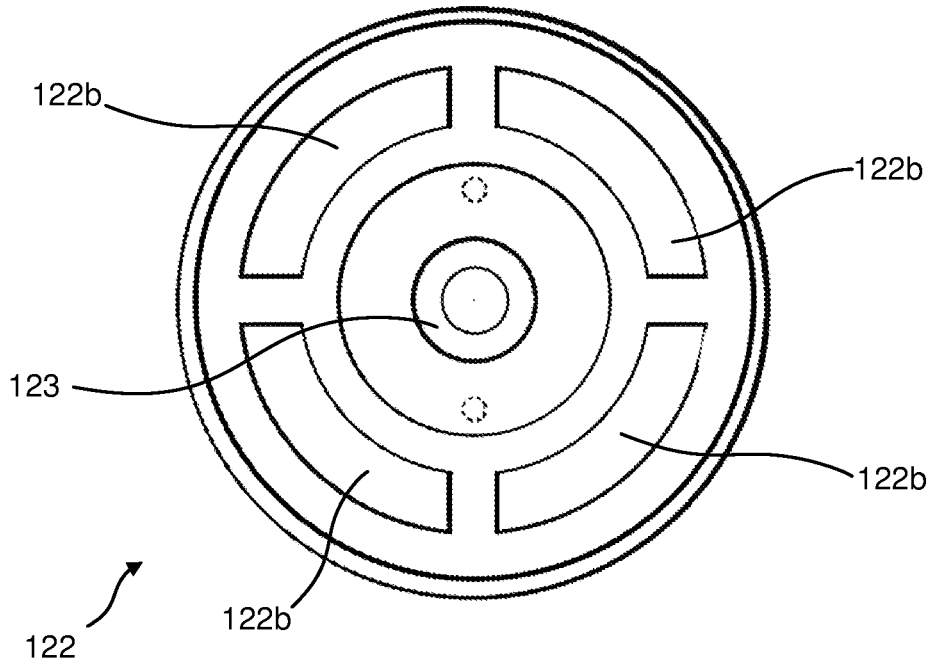
FIGS. 8A-8B are front and rear elevation views of an exemplary projectile feed disk according to an aspect of the invention.
Figure 8B:
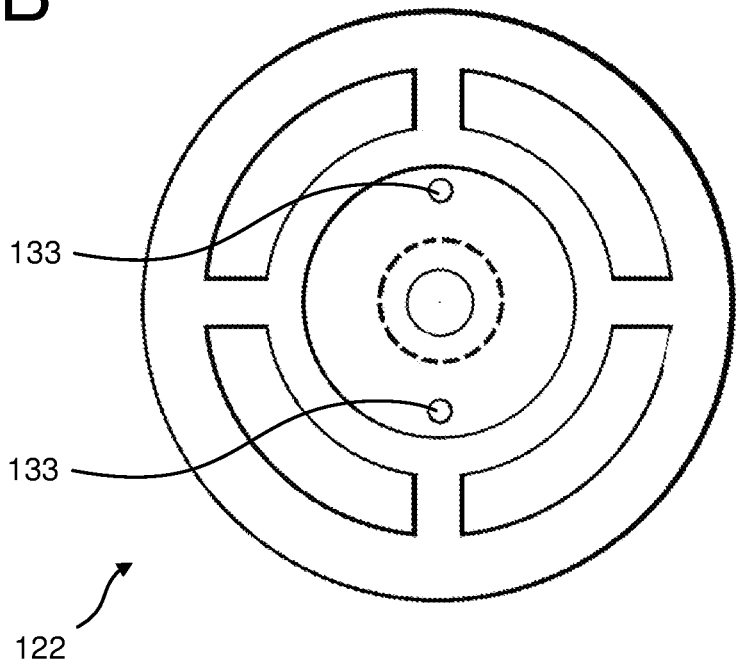

FIGS. 8A and 8B are elevation views of the feed disk 122, front and rear respectively. ("Front" in the gun 100 refers to the muzzle side. "Rear" in the gun 100 refers to the butt-stock side.)

Figure 9A:
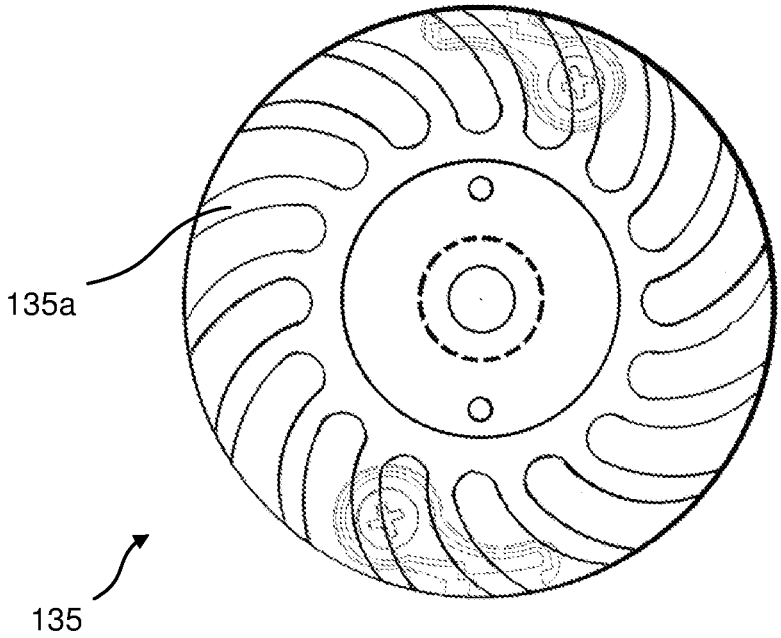
FIGS. 9A-9B are front and rear elevation views of an exemplary turbine according to an aspect of the invention.
Figure 9B:
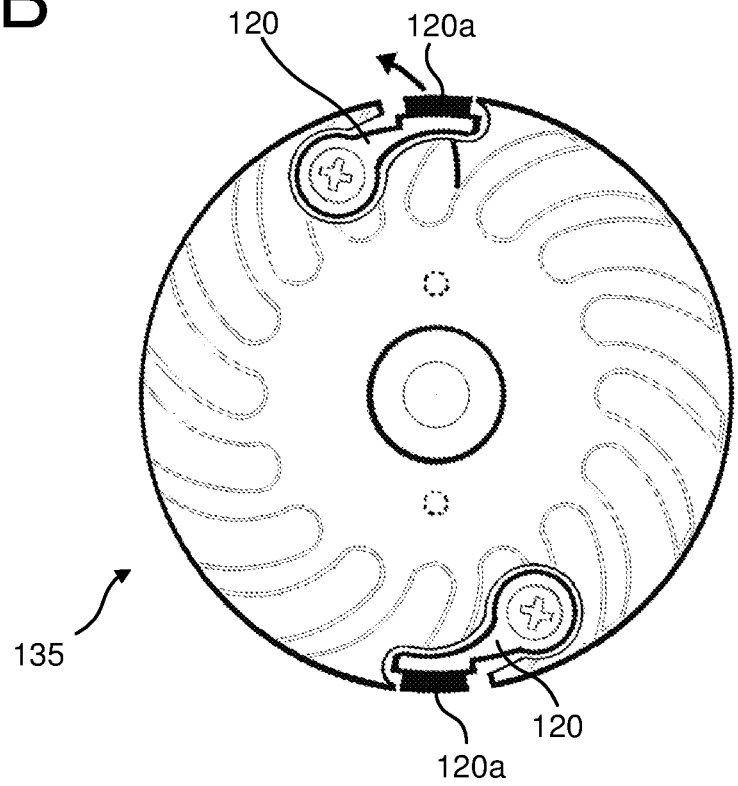

FIGS. 9A and 9B are elevation views of the turbine 135, front and rear respectively. The turbine 135 includes a number of blades 135*a* and rotational-speed governors 120 pivotably mounted to the body of the turbine 135. As described above, the blades 135*a* are configured to catch flowing pressurized air and thereby cause the turbine 135 to rotate about the axle 126. When the turbine 135 rotates about the axle 126, the governors 120 pivot radially outward from the center of the turbine 135 (due to inertia, often described as centrifugal force for rotating bodies). The floating ends 120*a* of the governors 120 (which may comprise a neoprene pad or the like) will then engage the inside wall of the housing 141 to create a frictional resistance to the rotation of the turbine 135 and thereby limit the rotational speed of the turbine 135.

Figure 10A:
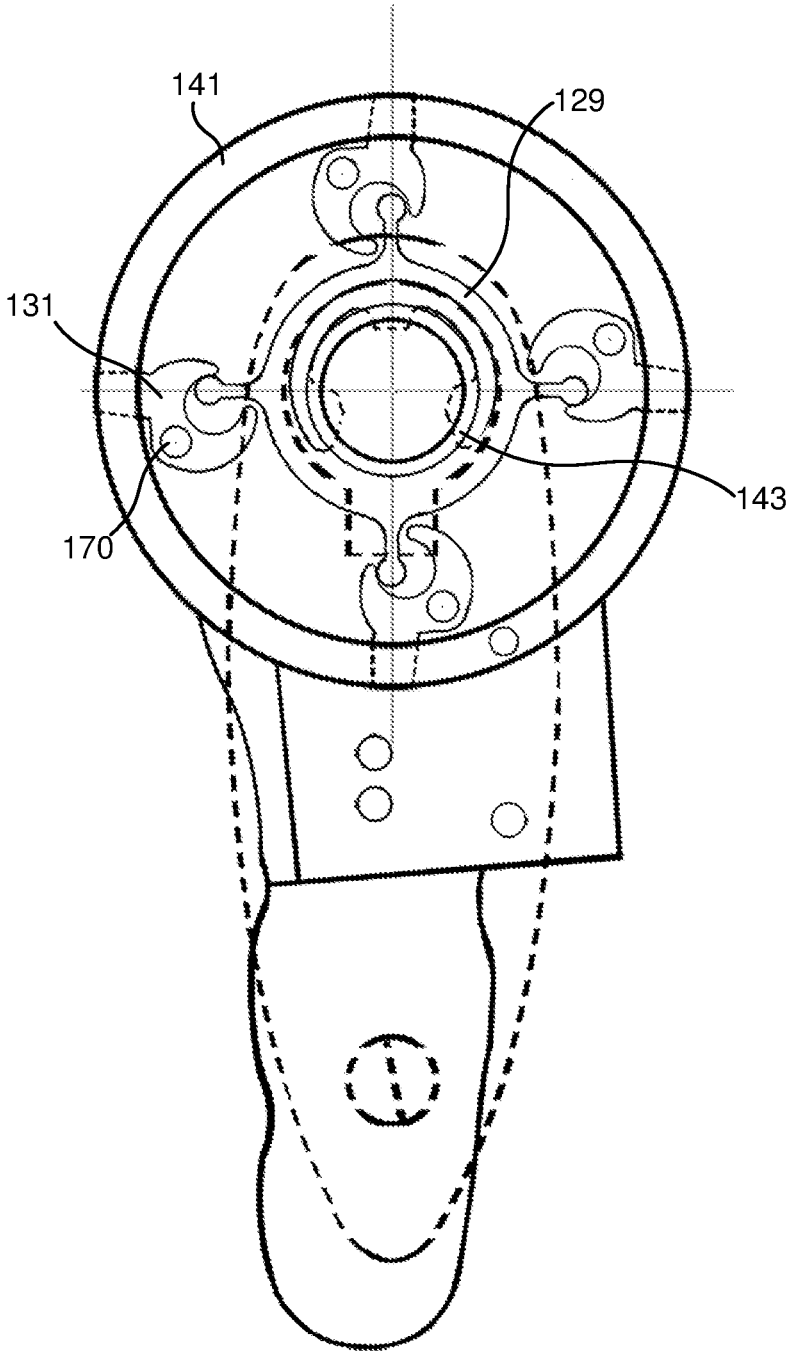
FIGS. 10A-10B are rear sectional views illustrating a rear seal assembly according to an aspect of the invention.
Figure 10B:
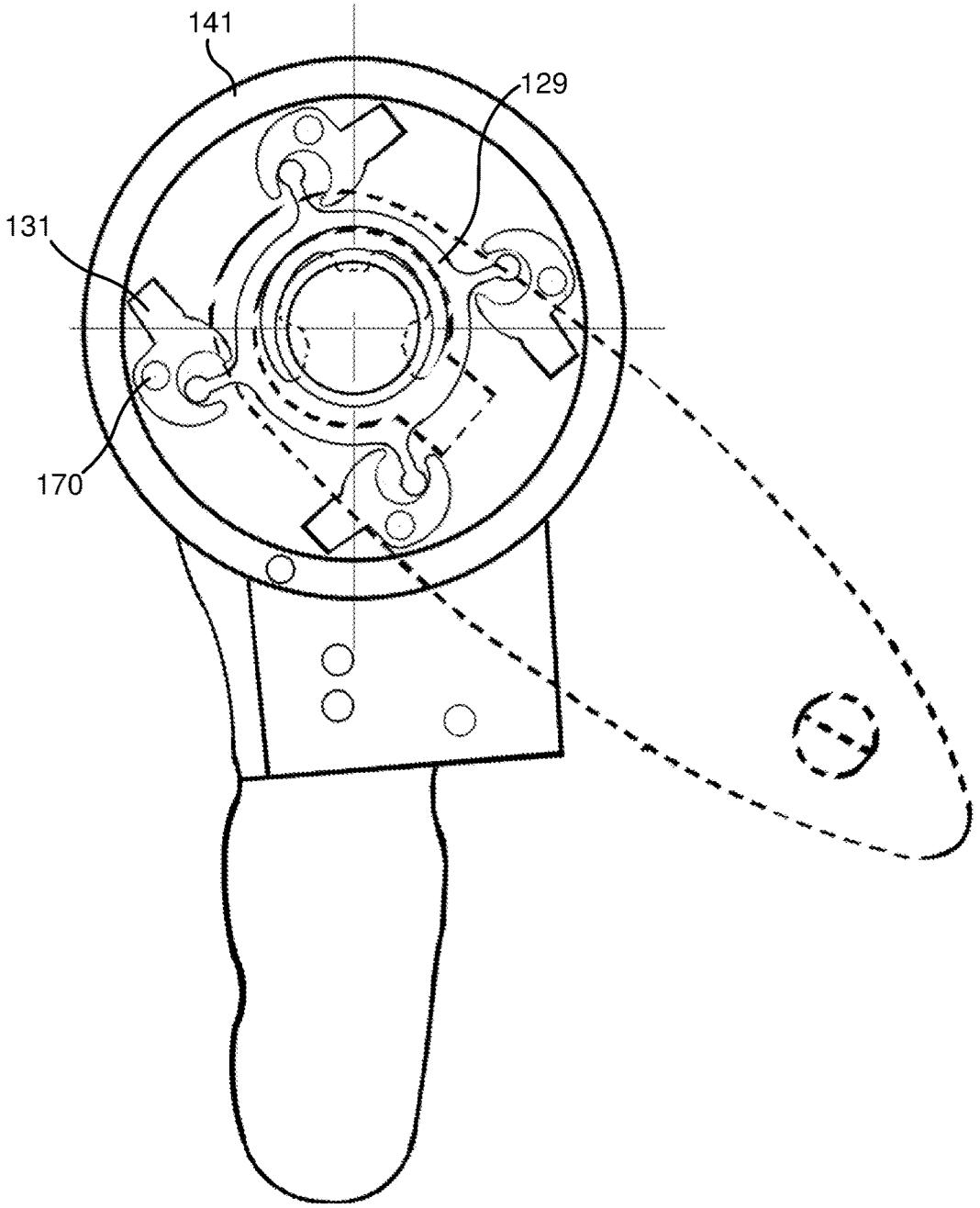

FIGS. 10A and 10B are rear sectional views of the gun 100 illustrating the drive assembly locked in place with the rear cam locks 131 engaged (FIG. 10A) and unlocked for removal from the housing 141 with the rear cam locks 131 disengaged (FIG. 10B). Multiple cam locks 131 may be cooperatively rotated by rotating a cam-lock actuator 129 attached to a butt-stock tube 143. A safety latch 176 (see FIG. 1A) may be used to prevent uncontrolled rotation of the butt-stock tube 143 to prevent unexpected disengagement of the cam locks 131 during operation of the gun 100. When rear cam locks 131 are disengaged, the drive assembly is unlocked and may be removed from the housing 141.

Figure 11:
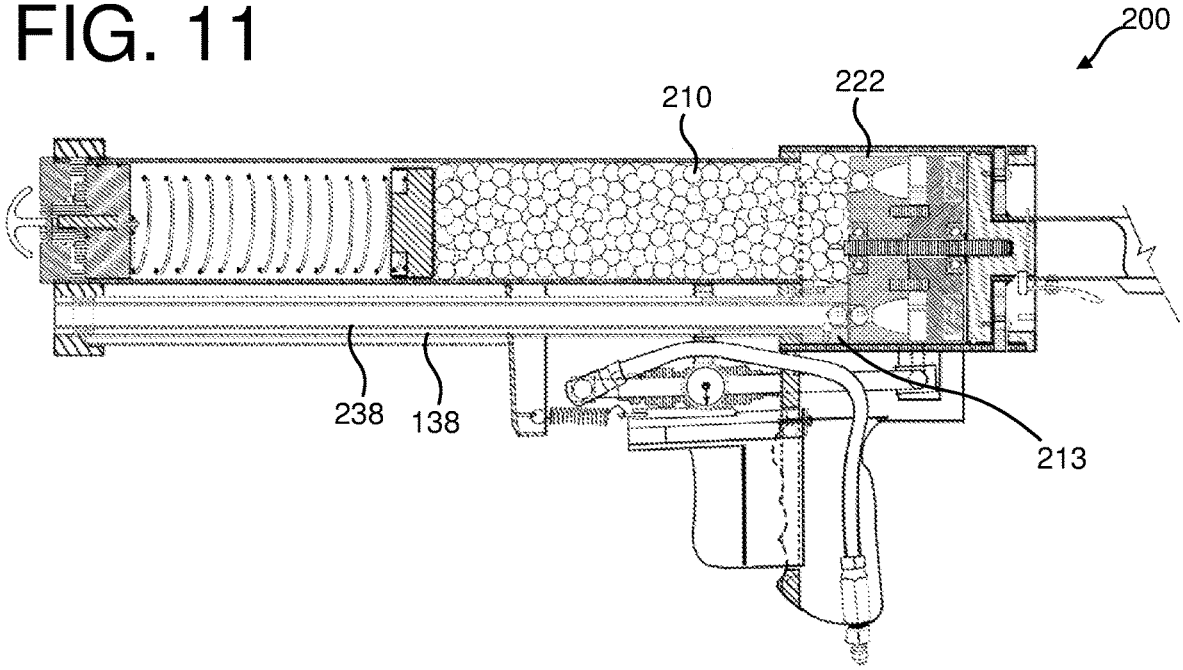
FIG. 11 is a side sectional view illustrating an exemplary compressed-air gun reconfigured for a smaller-caliber projectile according to an aspect of the invention.

As illustrated in FIG. 11, the gun 100 may be reconfigured into a gun 200 for a smaller caliber of projectile 210 by changing out the feed disk 122 to one with a different size groove 122*a* and through-ports 122*b*. This may be done by disengaging the rear cam locks 131, removing the drive assembly from the housing 141, removing the retaining clip 166, removing the feed disk 122 by sliding it off the axle 126 and drive pins 130, installing a different feed disk 222 by sliding it on the axle 126 and drive pins 130, reinstalling the retaining clip 166, reinstalling the drive assembly in the housing 141, and engaging the rear cam locks 131. The barrel insert 113 must be replaced with an insert 213 configured for the new caliber projectile and a properly-sized barrel 238 must be installed. The new barrel 238 may be installed within the original barrel 138 and the new barrel 238 may be integral to the new insert 213. This process of changing the caliber sizes can be accomplished in short order and without changes to the magazine section (other than in the choice of projectile with which to load into the magazine).

While the foregoing description is directed to the preferred embodiments of the invention, other and further embodiments of the invention will be apparent to those skilled in the art and may be made without departing from the basic scope of the invention. And features described with reference to one embodiment may be combined with other embodiments, even if not explicitly stated above, without departing from the scope of the invention. The scope of the invention is defined by the claims which follow.

The invention claimed is:

1. An air gun comprising:

(a) a tubular magazine comprising:

(i) a housing with a first end and a second end, (ii) an air-seal assembly disposed at the housing's first end, and (iii) a receptacle configured to hold spherical projectiles, (b) a cylindrical feed disk comprising a ported groove, a through-port, and a center hole, wherein the feed disk is disposed adjacent to the tubular magazine's housing's second end with the ported groove facing the tubular magazine's receptacle and wherein the ported groove is configured to receive a projectile from the tubular magazine's receptacle;

(c) a turbine comprising a blade and a center hole, wherein the turbine is connected to the cylindrical feed disk;

(d) an axle running through the center hole of the cylindrical feed disk and the center hole of the turbine such that the cylindrical feed disk and the turbine may rotate about the axle;

(e) a primary tubular barrel comprising a breech end and a muzzle end, wherein the breech end is disposed adjacent to the cylindrical feed disk; and (f) an air line configured to deliver pressurized gas from the valve to the turbine;

(g) wherein the through-port, ported groove, and primary tubular barrel are aligned at some rotation states of the cylindrical feed disk; and (h) wherein pressurized gas delivered to the turbine will flow through the through-port, ported groove, and primary tubular barrel when the through-port, ported groove, and barrel are aligned and thereby enable the pressurized gas to propel a projectile that is positioned in the ported groove out of the ported groove and through the primary tubular barrel.

2. The air gun of claim 1 further comprising:

(a) a spring disposed within the tubular magazine's receptacle; and (b) a piston disposed within the receptacle and connected to the spring, (c) wherein the spring and piston are disposed in the tubular magazine's receptacle such as to force any projectiles disposed in the receptacle toward the feed disk.

3. The air gun of claim 1 further comprising:

(a) a valve connected to the air line; and (b) a trigger connected to the valve such that movement of the trigger will open the valve.

4. The air gun of claim 3 further comprising:

(a) a gear rack connected to the trigger such the movement of the trigger results in movement of the gear rack; and (b) a gear connected to the valve such that rotation of the gear in one direction will open the valve and rotation of the gear in the other direction will close the valve;

(c) wherein the gear is meshed with the gear rack such that movement of the gear rack results in rotation of the gear.

5. The air gun of claim 1 wherein the tubular magazine's air-seal assembly includes:

(a) a cam disposed to selectively engage the tubular magazine's housing;

(b) a cam actuator disposed to engage the cam; and (c) a handle disposed to engage the cam actuator.

6. The air gun of claim 1 further comprising a barrel insert disposed between the feed disk and the primary tubular barrel, wherein the barrel insert includes:

(a) an alignment passage disposed in alignment with the primary tubular barrel; and (b) a shot guide disposed to intersect the ported groove such as to hold a projectile positioned in the ported groove in alignment with the alignment passage.

7. The air gun of claim 6 wherein the barrel insert further includes:

(a) a ball-guide passage;

(b) a ball disposed in the ball-guide passage; and (c) a spring disposed in the ball-guide passage and configured to force the ball along the ball-guide passage partially into the alignment passage.

8. The air gun of claim 1 further comprising a barrel insert disposed between the feed disk and the primary tubular barrel, wherein the barrel insert includes a secondary barrel extending into the primary tubular barrel.

9. The air gun of claim 1 further comprising a means for selectively locking the tubular magazine's air-seal assembly in the tubular magazine's housing.

10. The air gun of claim 1 further comprising a means for selectively locking the feed disk in position relative to the tubular magazine.

11. The air gun of claim 1 further comprising a governor pivotably mounted to turbine, wherein the governor is configured to extend from the turbine when the turbine is rotated.

* * * * *